US007971584B2

(12) United States Patent
Wiesner

(10) Patent No.: US 7,971,584 B2
(45) Date of Patent: Jul. 5, 2011

(54) SAWING STRIP AND METHOD FOR SIMULTANEOUSLY CUTTING OFF A MULTIPLICITY OF SLICES FROM A CYLINDRICAL WORKPIECE USING A SAWING STRIP

(75) Inventor: Peter Wiesner, Reut (DE)

(73) Assignee: Siltronic AG, Munich (DE)

( * ) Notice: Subject to any disclaimer, the term of this patent is extended or adjusted under 35 U.S.C. 154(b) by 1032 days.

(21) Appl. No.: 11/774,165

(22) Filed: Jul. 6, 2007

(65) Prior Publication Data

US 2008/0011134 A1 Jan. 17, 2008

(30) Foreign Application Priority Data

Jul. 13, 2006 (DE) ..... 10 2006 032 432

(51) Int. Cl.
*B28D 1/12* (2006.01)

(52) U.S. Cl. ..... 125/22; 125/16.02; 125/14; 83/651.1

(58) Field of Classification Search ..... 125/14, 125/16.01, 16.02, 22, 35; 451/60, 7, 390; 83/74, 435.14, 421, 31, 651.1
See application file for complete search history.

(56) References Cited

U.S. PATENT DOCUMENTS 1,438,100 A * 12/1922 Dey ..... 451/390
4,315,494 A * 2/1982 DiPlacido ..... 125/35
5,839,424 A * 11/1998 Hauser ..... 125/16.02
6,035,845 A 3/2000 Kaeser
6,065,461 A * 5/2000 Asakawa et al. ..... 125/16.02
6,367,467 B1 * 4/2002 McGregor et al. ..... 125/35
6,390,889 B1 5/2002 McGregor et al.
7,793,647 B2 * 9/2010 Skovgaard-Soerensen 125/16.02

2006/0243265 A1 11/2006 Hammer et al.
2009/0064982 A1 * 3/2009 Hammer et al. ..... 125/16.02

FOREIGN PATENT DOCUMENTS

CH 661471 A * 7/1987
DE 10 2004 058 194 A1 8/2005
DE 10 2005 007 312 A 11/2005
EP 0798091 A2 1/1997
JP 52057592 A * 5/1977
JP 9254144 A 9/1997
JP 10337647 A 12/1998
WO 2006061043 A1 6/2006

OTHER PUBLICATIONS

English Derwent Abstract AN 2005-788259 corresponding to DE 10 2005 007 312 A1.

* cited by examiner

*Primary Examiner* — George Nguyen
(74) *Attorney, Agent, or Firm* — Brooks Kushman P.C.

(57) ABSTRACT

A sawing strip for fixing a substantially cylindrical workpiece when cutting off slices from this workpiece with a wire saw has a first face, which is concavely curved perpendicular to its longitudinal direction for connecting to the workpiece, a second face opposite the first face for connecting to a mounting plate, and two side faces which connect the first face and the second face, two edges of the sawing strip at which the side faces meet the first face at a distance a from each other, an imaginary line on the first face marking its minimum distance d from the second face, the side faces being at a distance b, measured at the height of the line and perpendicular to the distance d, wherein the distance b is less than the distance a. The sawing strip is useful for decreasing waviness of wafers cut from a cylindrical workpiece using the sawing strip.

15 Claims, 1 Drawing Sheet

SAWING STRIP AND METHOD FOR SIMULTANEOUSLY CUTTING OFF A MULTIPLICITY OF SLICES FROM A CYLINDRICAL WORKPIECE USING A SAWING STRIP

BACKGROUND OF THE INVENTION

1. Field of the Invention

The invention relates to a sawing strip and to a method carried out using this sawing strip for simultaneously cutting off a multiplicity of slices from a cylindrical workpiece, in particular a workpiece consisting of semiconductor material, the workpiece and a wire frame of a wire saw performing, with the aid of a feeding device, a relative movement directed perpendicular to the longitudinal axis of the workpiece, by which the workpiece is guided through the wire frame.

2. Background Art

Semiconductor wafers are generally produced by a cylindrical, monocrystalline or polycrystalline workpiece of the semiconductor material being divided up into a multiplicity of semiconductor wafers simultaneously in one operation with the aid of a wire saw.

The main components of these wire saws include a machine frame, a feeding device and a sawing tool, which comprises a frame made up of parallel portions of wire. The workpiece is fixed on what is known as a sawing strip, generally by cementing or gluing it on. The sawing strip is in turn secured on a mounting plate, in order to clamp the workpiece in the wire saw. Various types of sawing strips are disclosed in U.S. Pat. No. 6,035,845. The sawing strips according to the prior art are distinguished by a substantially rectangular cross section, one side of the sawing strip being adapted to the cylindrical form of the workpiece by a concave curvature.

The wire frame of the wire saw is generally formed by a multiplicity of parallel portions of wire, which are clamped between at least two wire guiding rollers, the wire guiding rollers being rotatably mounted and at least one of them being driven. The portions of wire generally belong to a single, endless wire, which is guided spirally around the roller system and is unwound from a supply roller onto a take-up roller.

During the sawing operation, the feeding device brings about an oppositely directed relative movement of the portions of wire and of the workpiece. As a consequence of this feeding movement, the wire, to which a sawing suspension is applied, works its way through the workpiece, forming parallel sawing gaps. The sawing suspension, which is also referred to as slurry, contains particles of hard material, for example of silicon carbide, which are suspended in a liquid. A sawing wire with fixedly bound particles of hard material may also be used. In this case, application of a sawing suspension is not necessary. All that is needed is to add a liquid cooling lubricant, which protects the wire and the workpiece from overheating and at the same time transports slivers of workpiece out from the cutting gaps and away.

The production of semiconductor wafers from cylindrical semiconductor material, for example from single crystal ingots, places high requirements on the sawing method. It is generally the aim of the sawing method that each sawn semiconductor wafer has two faces that are as planar as possible and lie parallel to each other.

A part from the variation in thickness, the planarity of the two faces of the semiconductor wafer is of great significance. After the dividing up of a semiconductor single crystal, for example a silicon single crystal, by means of a wire saw, the wafers produced as a result have a wavy surface. In the subsequent steps, such as for example grinding or lapping, this waviness can be partially or completely removed, depending on the wave length and amplitude of the waviness and on the depth of the material removal. In the worst case, even after polishing, remnants of this waviness may still be detected on the finished semiconductor wafer, where they have adverse effects on the local geometry. These waves are present to varying degrees at different locations on the sawn wafer. Particularly critical is the end region of the cut, where particularly pronounced waves can occur and, depending on the kind of steps that follow, may also be detectable on the end product.

It is known from DE 102005007312 A1 that the wave in the end region of the cut that occurs in sawing processes according to the prior art is particularly pronounced in the case of slices which have been cut off from the ends of the cylindrical workpiece. In the middle of the workpiece (in the axial direction) on the other hand, the cut-off slices have virtually no waves in the end region of the cut. Furthermore, the axial back pressure gradient produced by the sawing suspension was identified as a cause of the wave produced at the end of the sawing process. According to DE 102005007312 A1, therefore, the amount of sawing suspension applied to the wire frame is reduced, and as a result the waviness of the sawn semiconductor wafers in the end region of the cut is reduced. However, it has been found that this measure is not adequate to satisfy the increasing requirements for the local geometry.

SUMMARY OF THE INVENTION

An object of the invention was therefore to reduce still further the local waviness produced in the end region of the cut when sawing semiconductor workpieces into wafers. This and other objects are achieved by use of a sawing strip which cradles the workpiece within a concave recess, the width of which, where it terminates contact with the workpiece, being greater than the width of the surface of the sawing strip to be secured on the mounting plate of the wire saw.

BRIEF DESCRIPTION OF THE DRAWINGS

The invention is described in more detail below on the basis of figures.

DETAILED DESCRIPTION OF THE PREFERRED EMBODIMENT(S)

Figure 1:
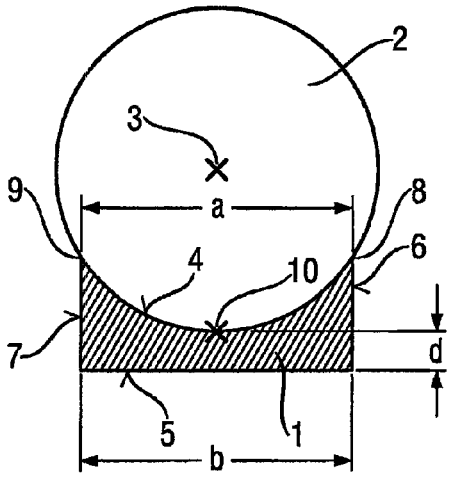
Fig. 1 (Prior Art)
FIG. 1 shows the cross section of a sawing strip according to the prior art with a cylindrical workpiece fixed on it.

The invention is thus directed to by a sawing strip 1 for fixing a substantially cylindrical workpiece 2 when cutting off slices from this workpiece 2 with a wire saw, the sawing strip 1 having a first face 4, which is concavely curved perpendicular to its longitudinal direction and is intended for connecting to the workpiece 2, a second face 5, which lies opposite the first face 4 and is intended for connecting to a mounting plate, and two side faces 6, 7, which connect the first face 4 and the second face 5, the two edges 8, 9 of the sawing strip 1 at which the side faces 6, 7 meet the first face 4 being at a distance a from each other, an imaginary line 10 on the first face 4 marking its minimum distance d from the second face 5, and the side faces 6, 7 being at a distance b, measured at the height of the line 10 and perpendicular to the distance d, wherein the distance b is less than the distance a.

The object is also achieved by a method for simultaneously cutting off a multiplicity of slices from a substantially cylindrical workpiece, the workpiece, connected to a sawing strip, and a wire frame of a wire saw performing with the aid of a feeding device a relative movement directed perpendicular to the longitudinal axis of the workpiece, by which the workpiece is guided through the wire frame, wherein a sawing strip according to the invention is used.

A sawing strip is an elongate strip which is produced from a suitable material, for example from graphite, glass, plastic or the like, and is intended for fixing a workpiece during the wire sawing process. A sawing strip according to the prior art is distinguished by a substantially rectangular cross section, but the face which is intended for fixing the cylindrical workpiece has a concave curvature corresponding to the workpiece, so that the form of the sawing strip is adapted to the form of the workpiece. According to the invention, in a way similar to according to the prior art, the fixing of the workpiece on the sawing strip is preferably performed by cementing or gluing it on. The adaptation to the form of the workpiece achieves an adherend surface area that is as large as possible, and therefore a connecting force between the workpiece and the sawing strip that is as great as possible. The form of a sawing strip can be generally described as follows:

First it is defined that the longitudinal direction of the sawing strip 1 is understood as meaning the direction parallel to the longitudinal axis 3 of the workpiece 2 connected to it. As described, the sawing strip 1 has a first face 4, which is concavely curved perpendicular to its longitudinal direction and is intended for connecting to the workpiece 2. Lying opposite the first face 4 is a second face 5, which is intended for connecting to a mounting plate (not represented). The faces 4 and 5 are connected by two side faces 6, 7. The two edges 8, 9, at which the side faces 6, 7 meet the first face 4, are at a distance a from each other. In the central region of the first face 4, a line 10 can be defined, running in the longitudinal direction through all the points on this face that are at a minimum distance d from the second face 5. Expressed another way, this line 10 runs in the longitudinal direction (i.e. parallel to the longitudinal axis 3 of the workpiece connected to the sawing strip) where the sawing strip 1 has the smallest thickness, this minimum thickness being synonymous with the distance d. The line 10 lies at the location at which the wire frame leaves the workpiece 2 at the end of the sawing process. A further dimension that is characteristic of the sawing strip is the length b of a line which intersects the line 10, is perpendicular to the distance d and the end points of which lie on the side faces 6, 7. Expressed another way, b is the distance between the side faces 6, 7, measured at the height of the line 10.

Figure 2:
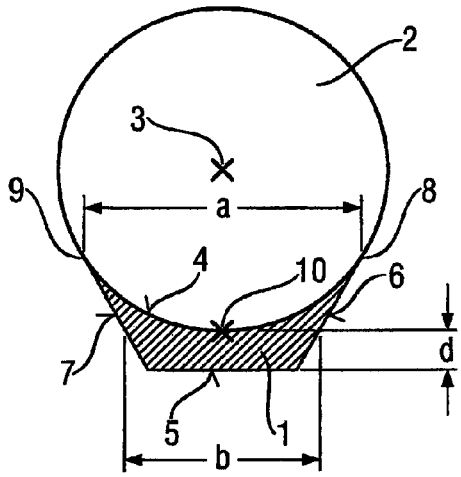
FIG. 2 shows the cross section of one embodiment of a sawing strip according to the invention with a cylindrical workpiece fixed on it.

A sawing strip 1 according to the invention (FIG. 2) is distinguished by the fact that the distance b is less than the distance a.

It is preferred for the relationship $0.5 \cdot a < b < 0.96 \cdot a$ to apply. It is particularly preferred for the relationship $0.6 \cdot a < b < 0.75 \cdot a$ to apply.

By contrast, in the case of a sawing strip according to the prior art (FIG. 1), the distances a and b are of equal size.

The use of the sawing strip according to the invention surprisingly leads to a significantly reduced waviness in the sawing-out region. It is not clear on what this effect is based. However, the following observation was made in the course of the investigations carried out in connection with the present invention:

During the sawing operation, sawing suspension is applied to the wire frame. The portions of wire transport the sawing suspension at high speed in the direction of the workpiece and into the sawing gaps, where it displays its abrasive action. As soon as the wire frame penetrates into a sawing strip according to the prior art, which has a substantially rectangular cross section, it can be observed that some of the sawing suspension is flung back far in the direction opposed to the movement of the wire by the impact with the straight side faces of the sawing strip, some of the sawing suspension that is flung back again hitting the portions of wire of the wire frame that are running in the direction of the workpiece. By contrast, when sawing into a sawing strip according to the invention, it is observed that some of the sawing suspension is flung back substantially vertically upward, but not in the opposed direction, by the impact with the sloping side faces of the sawing strip. The sawing suspension flung back onto the wire frame possibly causes uneven application of sawing suspension to the portions of wire or uncontrolled lateral deflection of the portions of wire in the longitudinal direction of the workpiece. It is conceivable that the reduction in the waviness in the sawing-out region is attributable to the extensive elimination of this effect. However, other explanations are also conceivable.

The sawing strip according to the invention is preferably symmetrical to a plane running through the longitudinal axis 3 of the workpiece 2 and the line 10. It is likewise preferred for the side faces 6, 7 to be planar faces. It is also preferred for the second face (5) to be a planar face.

The use of the sawing strip according to the invention is particularly advantageous when working with a sawing suspension containing particles of hard material, which is sprayed onto the wire frame with the aid of at least one nozzle unit during the cutting-off of slices from the workpiece. The sawing strip according to the invention may, however, also be used when using a sawing wire with bound particles of hard material, to which a liquid cooling lubricant is applied with the aid of at least one nozzle unit.

A nozzle unit refers to all the nozzles which apply sawing suspension or cooling lubricant to the wire frame on one side of the workpiece. A nozzle unit may for example be an elongate slot-shaped nozzle running parallel to the axes of the wire guiding rollers and to the axis of the workpiece, which is preferred. If a number of such nozzles are provided on one side of the workpiece above the wire frame, these nozzles together form a nozzle unit. A nozzle unit may also comprise a preferably linearly arranged row of individual nozzles, this row running parallel to the axes of the wire guiding rollers and to the axis of the workpiece and each nozzle having for example a round cross section and applying sawing suspension or cooling lubricant to a portion of wire of the wire frame.

If a sawing suspension is used, it is preferred to reduce the flow of the sawing suspension at the end of the cut, as disclosed in DE 102005007312 A1.

It is likewise preferred to increase the temperature of the sawing suspension over the last 10% of the cutting distance, in order to reduce the viscosity of the sawing suspension and consequently the back pressure gradient. The temperature of the sawing suspension is preferably increased by up to 20 K over the last 10% of the cutting distance.

The cutting distance is the distance covered altogether in the workpiece by the wire frame during the entire cutting operation, that is to say the entire feeding displacement in the workpiece. In the case of workpieces which have the form of a circular cylinder, the cutting distance corresponds to the diameter of the workpiece.

The best effect is achieved by a combination of the use of a sawing strip according to the invention with an increase in the temperature of the sawing suspension and simultaneous reduction of the flow of the sawing suspension at the end of the cut.

EXAMPLES

In order to investigate the effect of the use of the sawing strips according to the invention, a considerable number of cylindrical pieces of monocrystalline silicon ingot with a diameter of 300 mm and a length of 80 mm to 355 mm were cut by means of a commercially available four-roller wire saw into slices with a thickness of approximately 930 μm. A sawing suspension which contained particles of hard material, comprising silicon carbide, suspended in dipropylene glycol was applied to the sawing wire. At the end of the cut, the amount of sawing suspension was reduced, as described in DE 102005007312 A1. In half of the sawing operations, a sawing strip according to the prior art (comparative example) was used and in the other half a sawing strip according to the invention (example) was used.

On each of the silicon slices or wafers produced in this way, the waviness was determined in the sawing-out region. Waviness refers to dimensional deviations (peak to valley) in the spatial wavelength range of 2 mm to 10 mm, without the thickness variation component. The sawing-out region is defined as the last 50 mm of the cutting distance.

The waviness in the sawing-out region is determined as follows:

The measuring head of the measuring device, fitted with a pair of capacitive distance measuring sensors (one for the front side and one for the rear side of the silicon wafer), is guided over the front side and the rear side of the silicon wafer along the line running in the cutting direction through the center of the wafer. The cutting direction refers to the direction of the relative movement between the workpiece and the wire frame during the wire sawing operation. In this process, the distance between the sensors and the front or rear side of the silicon wafer is measured and recorded every 0.2 mm. The surface roughness in the spatial wavelength range of <2 mm is eliminated by a lowpass filter (Gaussian filter). After these steps, the evaluation curves for the front side and the rear side of the silicon wafer are available.

To determine the waviness in the sawing-out region, a window of 10 mm in length is then allowed to run over the last 50 mm, seen in the cutting direction, of each of the two evaluation curves for the front side and the rear side (rolling boxcar filtering). The maximum deviation (peak to valley) within the window is referred to as the waviness at the location of the center of the window. The greatest of all waviness on the front side and the rear side, determined over the last 50 mm of the evaluation curves, is referred to in the following comparative example and in the example as the waviness of the sawing-out region.

Comparative Example

Symmetrical sawing strips according to the prior art were used, the distances a and b (see FIG. 1) each being 170 mm and the thickness d being 14.5 mm. Altogether, approximately 1000 silicon wafers were produced in this way and the waviness of the sawing-out region was determined as prescribed above.

Example

Symmetrical sawing strips according to the invention with a=170 mm, b=114 mm and d=14.5 mm were used. Altogether, likewise approximately 1000 silicon wafers were produced in this way and the waviness of the sawing-out region was determined as prescribed above.

Figure 3:
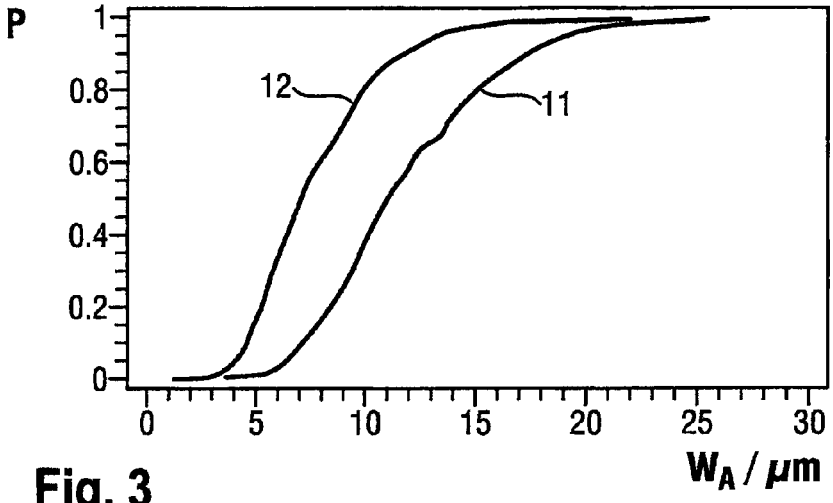
FIG. 3 represents a statistical comparison of the results with respect to the waviness in the sawing-out region when a sawing strip according to the prior art is used and when a sawing strip according to the invention is used.

The results of these measurements were statistically evaluated. The statistical evaluation is represented in FIG. 3. The waviness $W_A$ of the sawing-out region is plotted in tm on the x axis. The accumulated frequency P of the occurrence of 0 to 1 is plotted on the y axis. Curve 11 shows the result of the comparative example, curve 12 the result of the example. The curves respectively indicate what proportion of the silicon wafers at most have the waviness $W_A$ of the sawing-out region that is indicated on the x axis. So, for example, FIG. 3 reveals that only approximately 35% of the silicon wafers produced according to the comparative example (curve 11) have a waviness of the sawing-out region of at most 10 μm. On the other hand, however, approximately 80% of the silicon wafers produced according to the example (curve 12) have a waviness of the sawing-out region of at most 10 μm. Altogether, it is evident from the fact that curve 12 is shifted significantly to the left in comparison with curve 11 that the waviness of the silicon wafers produced according to the invention is considerably less than that of the silicon wafers produced according to the prior art. Furthermore, the steeper slope of the curve 12 reveals that it was possible to reduce the spread of the waviness of the sawing-out region in comparison with the prior art.

The application range of the invention extends to all sawing methods in which cylindrical workpieces are divided up into a multiplicity of slices by means of a wire saw and with a sawing suspension being supplied, and for which a high degree of planarity and a low degree of waviness of the products are important. The invention is preferably used for the production of semiconductor wafers, in particular silicon wafers. The term "cylindrical" is to be understood as meaning that the workpieces have a substantially circular cross section, certain deviations, for example orientation notches or flats applied to the lateral surface, being immaterial.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A sawing strip for fixing a substantially cylindrical workpiece when cutting off slices from this workpiece with a wire saw, the sawing strip having a first face which is concavely curved perpendicular to its longitudinal direction for connecting to the workpiece, a second face which lies opposite the first face for connecting to a mounting plate, and two side faces which connect the first face and the second face, two edges of the sawing strip at which the side faces meet the first face being at a distance a from each other, an imaginary line on the first face marking its minimum distance d from the second face, and the side faces being at a distance b, measured at the height of the line and perpendicular to the distance d, wherein the distance b is less than the distance a.

2. The sawing strip of claim 1, wherein the relationship $0.5 \cdot a < b < 0.96 \cdot a$ applies.

3. The sawing strip of claim 1, wherein the relationship $0.6 \cdot a < b < 0.75 \cdot a$ applies.

4. A method for simultaneously cutting off a multiplicity of slices from a substantially cylindrical workpiece, the workpiece connected to a sawing strip, and a wire frame of a wire saw performing with the aid of a feeding device a relative movement directed perpendicular to the longitudinal axis of the workpiece, by which the workpiece is guided through the wire frame, wherein the sawing strip is one of claim 1.

5. A method for simultaneously cutting off a multiplicity of slices from a substantially cylindrical workpiece, the workpiece connected to a sawing strip, and a wire frame of a wire saw performing with the aid of a feeding device a relative movement directed perpendicular to the longitudinal axis of the workpiece, by which the workpiece is guided through the wire frame, wherein the sawing strip is one of claim 2.

6. A method for simultaneously cutting off a multiplicity of slices from a substantially cylindrical workpiece, the workpiece connected to a sawing strip, and a wire frame of a wire saw performing with the aid of a feeding device a relative movement directed perpendicular to the longitudinal axis of the workpiece, by which the workpiece is guided through the wire frame, wherein the sawing strip is one of claim 3.

7. The method of claim 4, wherein the workpiece is connected to the sawing strip by cementing or gluing it to the sawing strip before beginning sawing.

8. The method of claim 4, wherein the wire frame is sprayed through the aid of at least one nozzle unit with a sawing suspension which contains particles of hard material suspended in a liquid during sawing.

9. The method of claim 5, wherein the wire frame is sprayed through the aid of at least one nozzle unit with a sawing suspension which contains particles of hard material suspended in a liquid during sawing.

10. The method of claim 6, wherein the wire frame is sprayed through the aid of at least one nozzle unit with a sawing suspension which contains particles of hard material suspended in a liquid during sawing.

11. The method of claim 7, wherein the wire frame is sprayed through the aid of at least one nozzle unit with a sawing suspension which contains particles of hard material suspended in a liquid during sawing.

12. The method of claim 8, wherein the temperature of the sawing suspension is increased over the last 10% of the cutting distance.

13. The method of claim 9, wherein the temperature of the sawing suspension is increased over the last 10% of the cutting distance.

14. The method of claim 10, wherein the temperature of the sawing suspension is increased over the last 10% of the cutting distance.

15. The method of claim 11, wherein the temperature of the sawing suspension is increased over the last 10% of the cutting distance.

* * * * *